United States Patent [19]

Redding

[11] Patent Number: 4,478,213

[45] Date of Patent: Oct. 23, 1984

[54] THERAPEUTIC LIMB MANIPULATOR

[76] Inventor: Donald E. Redding, Box 831, Port Orford, Oreg. 97465

[21] Appl. No.: 410,025

[22] Filed: Aug. 20, 1982

[51] Int. Cl.[3] ..... A61H 1/02

[52] U.S. Cl. ..... 128/25 R

[58] Field of Search ..... 128/25 R, 25 B; 272/70, 272/73, 93, 134, 125–126

[56] References Cited

U.S. PATENT DOCUMENTS

| | | | |
|---|---|---|---|
| 1,490,363 | 4/1924 | Couplin | 272/126 |
| 3,570,477 | 3/1971 | Scrivner | 272/73 X |
| 3,693,614 | 9/1972 | Schon | 128/25 R |
| 3,824,993 | 7/1974 | Grant | 128/25 R |
| 3,830,231 | 8/1974 | Klein | 128/25 R |
| 4,262,902 | 4/1981 | Dranselka | 272/73 X |

FOREIGN PATENT DOCUMENTS

| | | | |
|---|---|---|---|
| 556620 | 2/1957 | Italy | 128/25 R |

*Primary Examiner*—Richard J. Apley
*Assistant Examiner*—Chris Coppens

[57] ABSTRACT

A body member has opposite legs for supporting it adjacent a patient. The body member has a crank assembly to which the terminal end of limbs of the patient are attached for a cranking type manipulation. One embodiment of the invention is arranged to exercise the legs of a patient and includes knee support straps supported for lateral movement in a hollow support arm. In another embodiment, the manipulator has attachments including an elongated rear leg that allows the crank assembly to be disposed close to the patient for connection to the hands.

1 Claim, 3 Drawing Figures

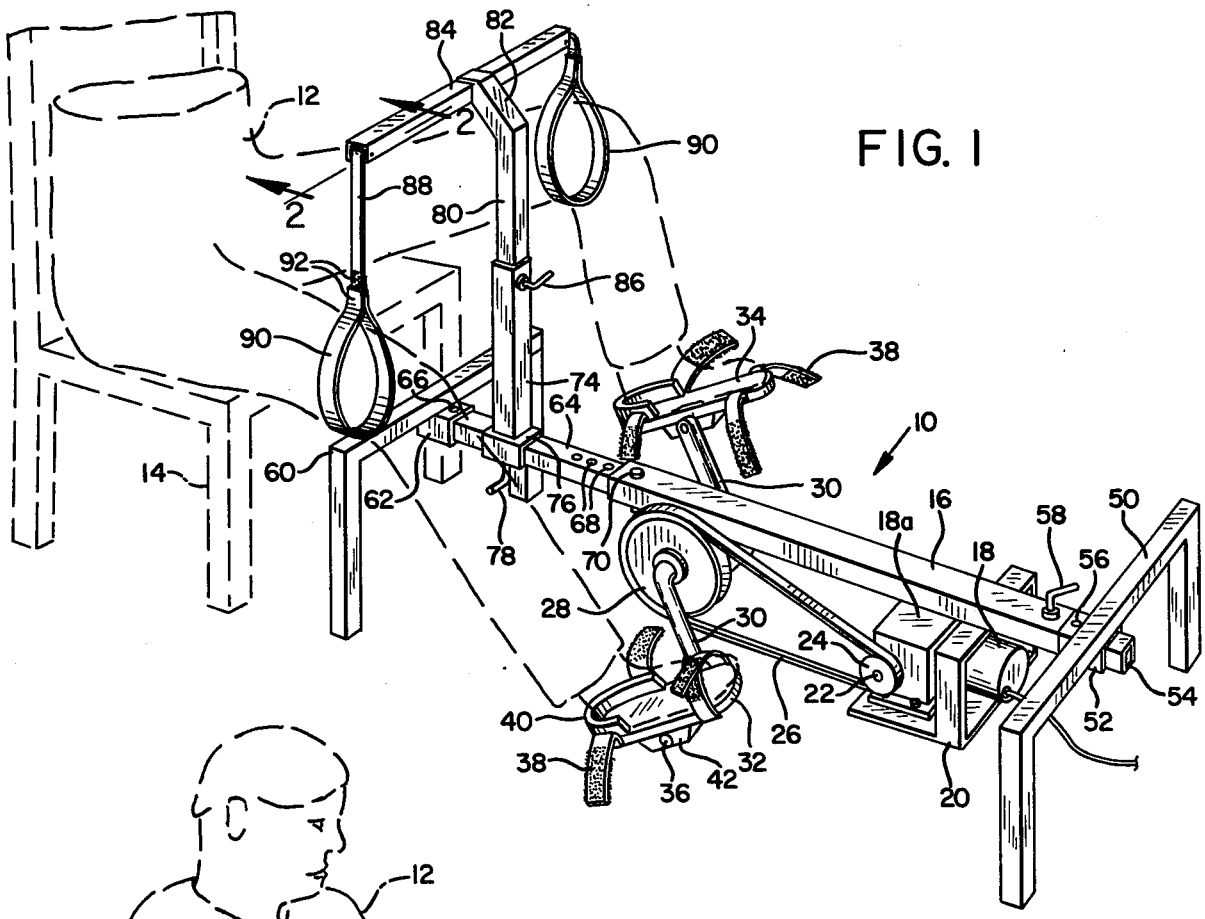
FIG. 1
FIG. 2
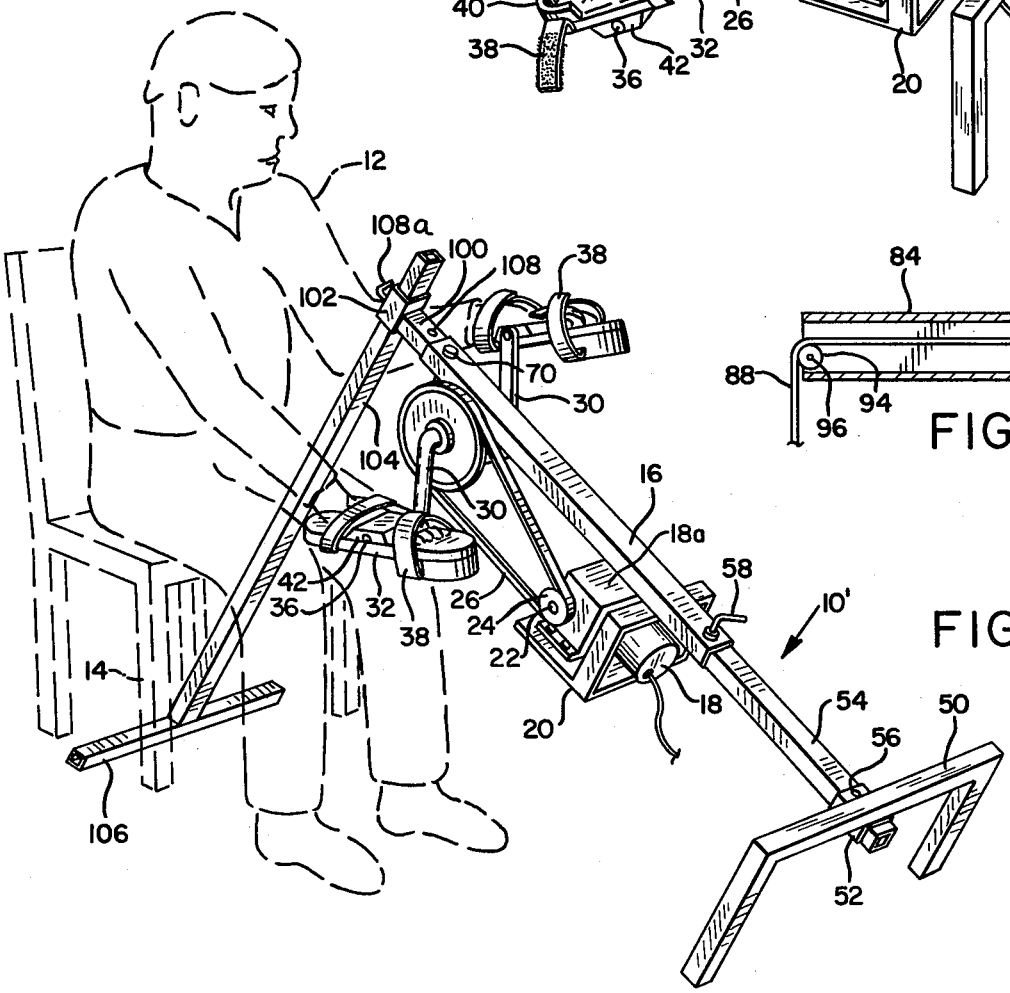
FIG. 3

THERAPEUTIC LIMB MANIPULATOR

BACKGROUND OF THE INVENTION

Various devices have been provided for exercising the limbs of a patient such as bicycle-type machines, rowing machines, and other devices. Some patients, however, are not capable of providing the strength necessary to operate an exercise apparatus but rather require a manipulation of the limbs in order to build muscle strength, circulation, etc. Such manipulation has been performed manually by nurses or other technicians. Such of course is oftentimes inconvenient for both the patient and the technician and in addition is somewhat expensive if the technician who is performing the manipulating treatment is a trained professional.

SUMMARY OF THE INVENTION

According to the present invention and forming a primary objective thereof, a therapeutic limb manipulator is provided that is arranged to take the place of manual treatment by another person and which provides a manipulative function that accomplishes the desired therapeutic treatment.

Another object is to provide a therapeutic limb manipulator of the type described that has a novel structural arrangement and adjustable members which allow it to be adjusted to patients in various positions and also to allow treatment of either the arms or legs.

In carrying out the objectives of the invention, the device comprises a body member with means arranged to support it on a supporting surface such as the floor or on a bed. The device has a powered crank mechanism with means to secure the terminal end portions of a person's limbs whereby upon rotation of the crank mechanism under power the terminal end portions of the person's limbs are moved in a circle to manipulate the limbs without any muscular force being required by the person being treated. The device has adjustments and attachments making it capable of use either in the manipulation of the legs or the arms. For the purpose of manipulating the legs, the body member has attachments including a standard with strap means which can be looped around the knee portions of the patient's legs and which can provide support for the legs as the legs are being manipulated. For the purpose of manipulating the arms the body member has attachments including an elongated rear leg that allows the crank member to be disposed close to the patient for connection to the hands.

The invention will be better understood and additional objects and advantages will become apparent from the following description taken in connection with the accompanying drawings.

BRIEF DESCRIPTION OF THE DRAWINGS

FIG. 1 is a perspective view of the present therapeutic limb manipulator showing attachments therefor and adjustment for manipulating the legs of a patient in a sitting position;

FIG. 2 is an enlarged fragmentary sectional view taken on the line 2—2 of FIG. 1; and FIG. 3 is a perspective view of the manipulator showing attachments and adjustment for manipulating the arms of a patient.

DETAILED DESCRIPTION OF A PREFERRED EMBODIMENT

With particular reference to the drawings and first to FIGS. 1 and 2, the manipulator is designated generally by the numeral 10 and is structured for manipulating the legs of a patient 12 while in a sitting position in a chair 14. While the invention is greatly functional with a patient sitting in a chair or the like, it is to be understood that its structure allows it to be used in other positions of the patient, such as in a wheelchair, in a bed, or other location.

The manipulator comprises a body member 16 made of tubular stock and supporting an electric motor 18 in an integral depending connection by means of a motor frame 20. Motor 18 has a gear reduction assembly 18*a* with an output shaft 22 having a pulley 24 keyed thereto and operating a belt 26 in turn operating a pulley 28 on a crank mechanism 30 supported on the body member 16.

Crank mechanism 30 has opposite arms similar to a bicycle drive arrangement, namely, the arms are disposed 180 degrees apart, and each of such arms terminates in a pedal type platform 32 for attachment to the feet of the patient. Such platforms have a pivot connection 36 with the outer ends of arms 30 and include detachable strap means 38, such as Velcro, for removably attaching the feet thereto. Platforms 32 also preferably have a rear upright curved flange 40 forming a rear abutment against which the heel of the foot may bear when the foot rests on the platform. The underside of the platform includes a block 42 which provides for placement of the pivot 36 and also forms a hand rest when the device is to be used for manipulating the arms, as will be more apparent hereinafter.

Support of the body member 16 for use as a manipulator for a patient's legs comprises a front inverted U-shaped leg member 50 having a central horizontal socket 52 secured integrally thereto and arranged to receive a connecting bar 54 having telescoping relation in the socket 52 and also in the body member 16. A set screw 56 is provided in the socket 52 for detachably securing the connecting bar 54 to the socket and a set screw 58 is provided in the body member 16 for adjustable and removable attachment of the connecting bar to such body member.

Rear support of the body member is provided by a second inverted U-shaped leg member 60 having a horizontal socket 62 integral therewith and arranged to receive a rear connecting bar 64. This connecting bar is arranged to be received in the body member 16 in telescoping relation. Bar 64 is removably secured to the socket 62 by a set screw 66 and has length adjustment in the body member 16 by means of a plurality of longitudinally spaced holes 68 therein one of which is arranged to receive a removable lock pin 70 in the body member.

An upright tubular standard 74 has a bottom integral horizontal socket 76 arranged to receive the connecting bar 64. Socket 76 has a set screw 78 therein for adjustable attachment to the bar. The tubular standard 74 receives a top extension bar 80 through its upper end which is turned rearwardly at 82 and which terminates in a tubular cross arm 84. Extension bar 80 has anchored height adjustment in the standard 74 by means of a set screw 86. A strap 88 extends through the cross arm 84 and terminates in end loops 90 arranged to receive the legs of the patient adjacent the knees. Preferably, the loops 90 can be opened, namely, opposing parts have detachable connecting portions 92 such as Velcro for easy attachment to and detachment from the leg. With particular reference to FIG. 2, end portions of the arm 84 interiorly thereof have rollers 94 mounted on shafts 96 in the bar for substantially friction-free and wear-free reciprocation of the strap through the cross arm.

In the operation of the leg manipulator of FIG. 1, the parts are assembled by installing the front and rear leg membeers 50 and 60 in the body member 16 and fastened in selected length adjustment by the set screw 58 and the lock pin 70. The adjustment is made such that with the patient sitting in a chair at the rearward end of the manipulator, as shown in broken lines, the feet can be supported on the platforms 32 and secured in place by the straps 38. In this position of the patient, the extension bar 80 is adjusted in height and longitudinally with standard 74 on the bar 64 such that the end loops 90 can be formed around the patient's legs just rearward of the knees when the feet are supported on the platforms. The loops 90 are formed in the length adjustment of the strap 88 such that they support the legs at the knees but allow the legs to alternately straighten and bend as the platforms 32 are driven in a bicycle action. As the platforms move around in their circular pattern, the strap 88 rolls back and forth on the rollers in the cross arm 84 to accommodate the up and down alternate movement of the legs.

With reference to FIG. 3, the manipulator 10' with some alternate attachments, can as well be used to manipulate the arms. The body member 16 and crank assembly 30 are identical to the structure shown in FIG. 1, as is the front support comprising the leg member 50 and connecting bar 54. In this embodiment, however, the body member 16 is associated with a rear connecting bar 100 having an upright socket 102 for receiving a single elongated leg 104 having a lateral foot 106. Connecting bar 100 has apertures 108 associated with the lock pin 70 for length adjustment, and socket 102 has a set screw **108*a* engageable with the leg 104** for detachable length adjustment.

Leg 104 is of sufficient length such that the body member can be angled upwardly as shown whereby the patient in a seated position straddles the leg 104 and has the hands attached to the platforms 34.

In this arm manipulating structure, the platforms 32 are turned over relative to the leg manipulating position wherein the hands lay over the blocks 42 in a comfortable position. The straps 38 hold the hands in place on the platforms. Upon operation of the motor, the arms are manipulated for therapeutic treatment.

According to the invention, the embodiments of the invention have necessary adjustment for accommodating patients to be treated. The patient can be seated in a chair as shown or the patient could as well be treated from a wheelchair. In addition, the device could be placed on a bed for a bedridden patient. The motor unit **18, 18*a* is of a variable speed type so that the speed of manipulation can be controlled according to the requirements of the patient. The loop forming ends 90 in their adjustment can accommodate patients of different stature. In the embodiment of FIG. 3**, the position of the manipulator to the patient can provide the treatment desired, namely, if the manipulator is close to the patient, the hands and forearms will mostly receive the movement of the crank assembly but if the manipulator is spaced farther from the patient so as to fully extend the arms, the arms as well as the shoulders are worked. Although the device will manipulate the limbs without any muscular force being required by the patient, it is to be understood that the patient can exert a force in excess of the speed of the device if desired.

It is to be understood that the forms of my invention herein shown and described are to be taken as preferred examples of the same and that various changes in the shape, size and arrangement of parts may be resorted to without deprting from the spirit of my invention or the scope of the subjoined claims.

Having thus described my invention, I claim:

1. A therapeutic limb manipulating apparatus for exercising either the legs or arms of a patient, comprising (a) a longitudinal body member having front and rear portions longitudinally adjustable with each other for varying the length of said body member, (b) front support means on said body member, (c) attaching means on the rear portion of said body member arranged to be associated with rear support means capable of positioning said body member in selected positions depending on its use as a leg manipulator or arm manipulator, (d) crank means on said rear portion of the body member having opposite pedals spaced 180 degrees apart, (e) motor means on said body member operatively connected to said crank means for rotating the latter, (f) each of said pedals having pivot connection to said crank means and also having opposite surfaces, (g) strap means for attaching the feet and hands to said surfaces, (h) one of said surfaces having a heel rest for supporting the feet for use of the apparatus as a leg manipulator and the other surface comprising a hand engaging surface for supporting the hands for use of the apparatus as an arm manipulator whereby upon adjusting the body member and length for securing the hands or feet on said pedals and upon selective association with a rear support means, the feet or arms of a patient who is positioned adjacent the apparatus are exercised by operation of said motor means, (i) a standard mounted on the rear portion of said body member for adjustment longitudinally along the latter, (j) and strap means on said standard having opposite ends terminating in loops arranged to loop around the knee portions of a patient's legs and provide support for the legs as the legs are being manipulated by said crank member, (k) said strap means being supported on said standard for lateral reciprocal movement as said limbs are manipulated in alternating relation, (l) said standard being adjustable in height for adjustment to a patient.

* * * * *